United States Patent [19]

Greenwood

[11] Patent Number: 4,603,687

[45] Date of Patent: Aug. 5, 1986

[54] CONTINUOUS PASSIVE MOTION ORTHOPEDIC DEVICE

[76] Inventor: Eugene C. Greenwood, 2956 B Peppertree La., Costa Mesa, Calif. 92626

[21] Appl. No.: 520,916

[22] Filed: Aug. 8, 1983

[51] Int. Cl.[4] ..... A61H 1/02

[52] U.S. Cl. ..... 128/25 R

[58] Field of Search ..... 128/25 R, 25 B, 80 R, 128/80 F, 80 H, 24 R, 24.1; 272/96

[56] References Cited

U.S. PATENT DOCUMENTS

| | | | |
|---|---|---|---|
| 2,581,110 | 1/1952 | Kenworthy | 128/80 R |
| 2,827,897 | 3/1958 | Pawlowski | 128/80 F |
| 3,929,335 | 12/1975 | Malick | 128/25 R X |
| 3,989,240 | 11/1976 | Victor | 128/25 R X |
| 4,079,931 | 1/1978 | Valentine | 272/73 |
| 4,492,222 | 1/1985 | Hajianpour | 128/25 R |
| 4,509,509 | 4/1985 | Bouvet et al. | 128/25 R X |

FOREIGN PATENT DOCUMENTS

| | | | |
|---|---|---|---|
| 0022002 | 1/1981 | European Pat. Off. | 128/25 R |
| 0308886 | 2/1916 | Fed. Rep. of Germany | 128/25 R |
| 2015054 | 10/1971 | Fed. Rep. of Germany | 128/25 R |
| 2454798 | 4/1979 | France | 128/24 R |
| 0848027 | 7/1981 | U.S.S.R. | 128/25 R |

*Primary Examiner*—Robert A. Hafer
*Assistant Examiner*—Kathleen D'Arrigo
*Attorney, Agent, or Firm*—Norman B. Rainer

[57] ABSTRACT

A continuous passive orthopedic device for the exercising of limbs for therapy, rehabilitation or healing, including a compact drive mechanism which permits the device to be located solely within the confines of a standard hospital bed and permits the leg of a patient to be supported in a near horizontal position when it is straight. Control of the angle of flex is accomplished through a control instrument located at the knee joint. The control instrument includes a pair of adjustable indicators which can be moved to the desired end points of flexure. The device includes a narrow base plate which allows the patient to keep his legs closer together during use. Also included is a mechanism whereby the ankle can be flexed between preset angles simultaneously with the flexing of the knee.

18 Claims, 14 Drawing Figures

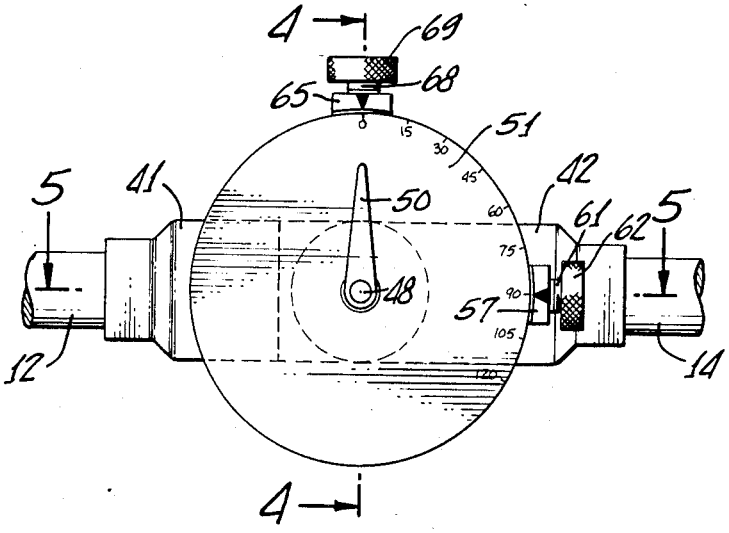
FIG. 2.
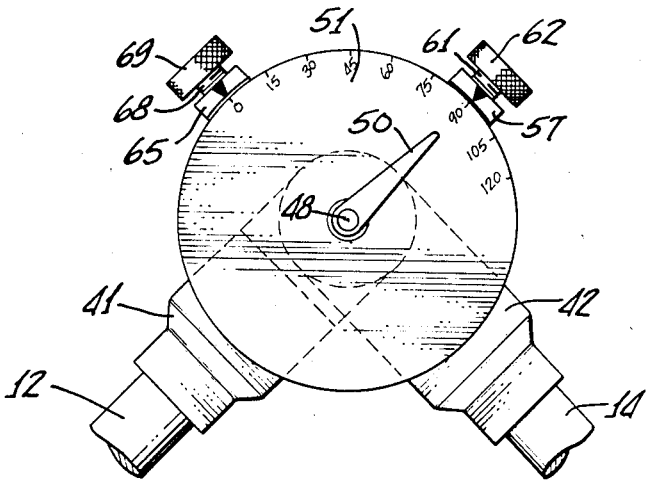
FIG. 3.
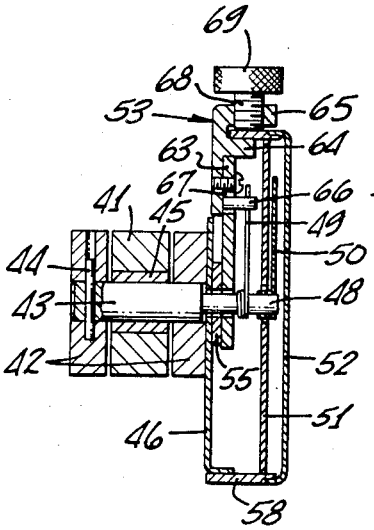
FIG. 4.
FIG. 5.
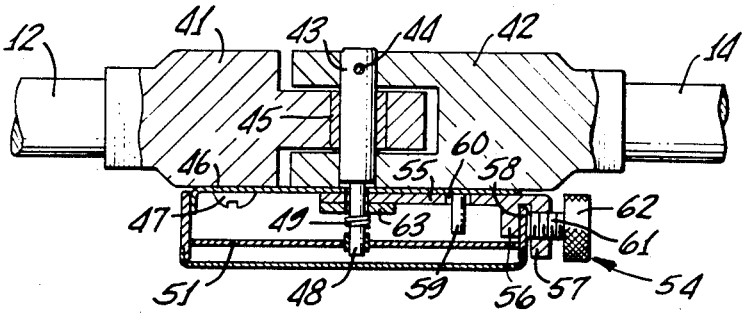

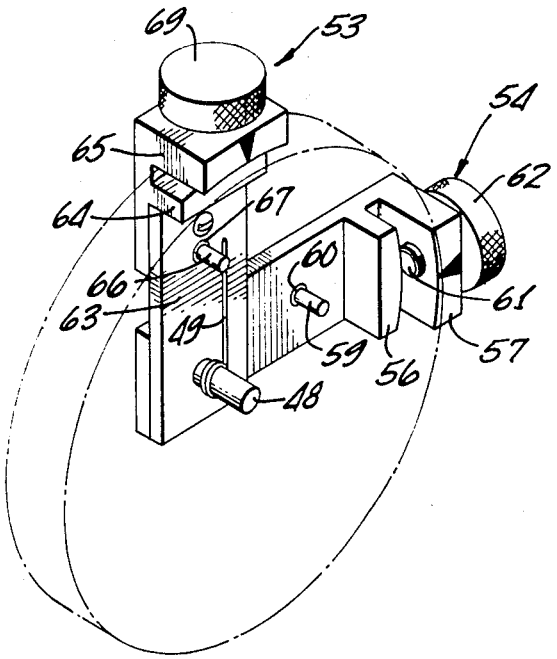
FIG. 6.
FIG. 7.
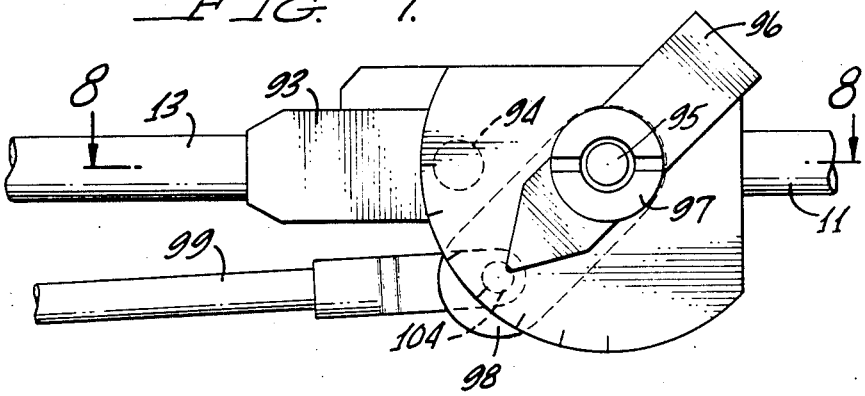
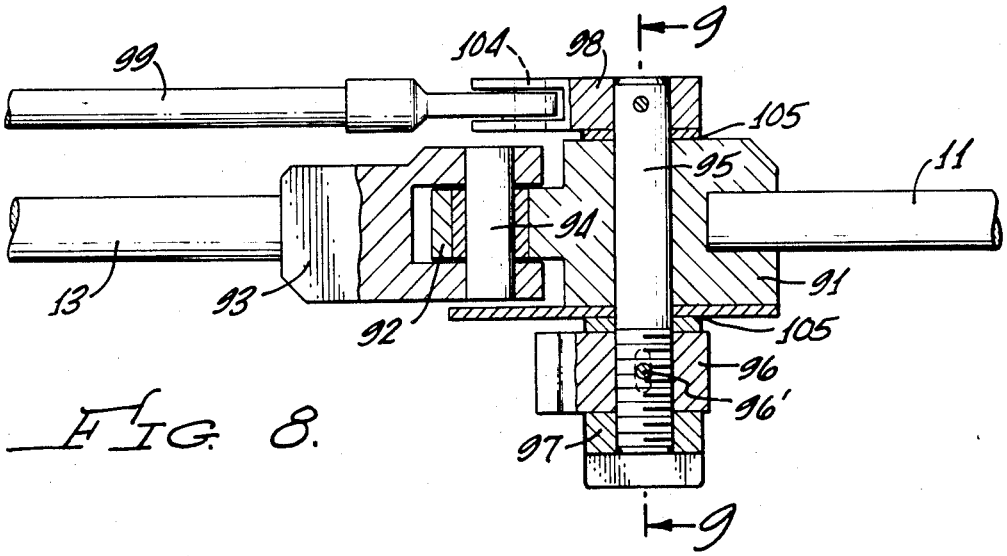
FIG. 8.

CONTINUOUS PASSIVE MOTION ORTHOPEDIC DEVICE

BACKGROUND OF THE INVENTION

1. Field of the Invention

The present invention relates to a continuous passive motion device and, more particularly, to an orthopedic device for the continuous passive exercising of limbs for therapy, rehabilitation or healing.

2. Description of the Prior Art

It has been known for many years that the slow, continuous flexing of a joint, such as the knee, following surgery on that joint will promote rapid healing, reduce pain during healing and result in an increased range of motion of the joint when healing is completed. Thus, in the medical specialty of orthopedics, devices for the continuous passive exercising of limbs for therapy, rehabilitation or healing are known. This continuous passive motion is usually applied to a frame which cradles the leg within it, while the frame is driven slowly up and down with an electric motor and drive screw. The drive mechanism is usually located beneath the leg, with the leg raised at an angle of from 6° to 15° in order to clear the motor and drive screw beneath. This has caused difficulty as it is sometimes preferable to have the leg in a near horizontal position when it is straight.

Another problem results from the limited distance between the hips and foot of a standard hospital bed. The usual method of driving the device is to impart a force to the area of the foot, moving it horizontally toward the buttocks. Since the distance the foot must travel in order to fully flex the knee is between 20 and 30 inches, this requires a mechanism of this length or longer. This results in great difficulty in containing the length within the restricted length of a standard hospital bed.

Another problem which is incurred is that of setting and controlling the angle of flex. In the early stages of treatment, such as immediately following surgery, it is often desirable to have a small flex angle, i.e. a total of 40°, between 20° and 60°. The logical place to measure and control the flex angle is at the knee joint. However, since this is a moving joint in the orthopedic device, problems arise when using it for control purposes. Previous designs have installed potentiometers in the knee joint which give out a voltage commensurate with the angle. This voltage is then fed through a wire to another location where two other potentiometers have been located as part of a control unit. These control potentiometers can then be set at two given points so as to produce output voltages corresponding to the high and low voltages emanating from the potentiometers located at the knee joint. When there is a match between the voltages emanating from the potentiometers located at the knee joint and the control potentiometers, a circuit causes the voltage to the drive motor to reverse, reversing the direction of motion of the device. A voltage meter is then used to indicate the angle of the knee joint as a function of the voltage emanating from the potentiometers located at the knee joint. In actual use, certain inaccuracies have been found inherent in such a system which converts voltages to angular measurements.

It is also desirable to provide a device which is simple, lacking in complexity, and permits the patient to keep his legs close together so that it is comfortable and convenient to use. For one reason or another, available devices have not satisfied this requirement. Typical of the available devices are those described in U.S. Pat. Nos. 2,763,261, 4,089,330 and 4,323,060.

SUMMARY OF THE INVENTION

According to the present invention, there is provided a continuous passive orthopedic device for the exercising of limbs for therapy, rehabilitation or healing which overcomes the above-described problems. In order to have the leg in a near horizontal position when it is straight and to have the device located solely within the confines of a standard hospital bed, apparatus has been devised for providing a compact drive mechanism with a very short stroke. This is accomplished by connecting a linear drive mechanism between a base and the hinge supporting one end of a thigh support member. The force of the linear drive mechanism is applied through a wishbone-shaped drive fork which straddles the thigh at the open end of the drive fork, allowing the upper leg to be nestled therein. Connecting the drive fork to the thigh support member at a point closely adjacent the end thereof connected to the base causes a large degree of knee rotation for a short amount of drive movement. While this type of lever system increases the force required, this is easily handled with conventional linear drives.

The control of the angle of flex is accomplished through a control instrument located at the knee joint. This control instrument includes a pair of adjustable indicators which can be moved to the desired end points of flexure. This simultaneously moves interior switching points. On the exterior of the control instrument is a pointer which reads the angle at the knee joint directly. As the angle changes during operation of the device, an internal contact arm rotates until it comes up against the interior switching points. When contact is made, control signals are generated. This results in a simple and efficient system for controlling the angle of flex. These control signals can be used to either reverse the direction of hydraulic flow to a solenoid valve or the direction of current to a motor.

Another improvement is the incorporation of a narrow base with an outrigger rod adjacent the foot which may be removed during shipment. The narrow base allows the patient to keep his legs closer together, not requiring the wide apart spread which a wider base necessitates. The outrigger rod prevents the device from tipping over when in the raised position.

The present device also includes a simple mechanism whereby the ankle can be flexed between preset angles simultaneously with the flexing of the knee.

OBJECTS, FEATURES AND ADVANTAGES

It is therefore the object of the present invention to solve the problems encountered heretofore in providing an orthopedic device for the continuous passive exercising of limbs for therapy rehabilitation or healing. It is a feature of the present invention to solve these problems by providing a novel arrangement of base, thigh and calf support members, linear drive and drive fork. An advantage to be derived is the ability to have the leg of a patient in a near horizontal position when it is straight. A further advantage is a device which can be readily positioned within the confines of a standard hospital bed. Still another advantage is a simple and uncomplex structure.

It is another feature of the present invention to solve these problems by the provision of a novel control instrument. An advantage to be derived is a control instrument which is simple and accurate.

It is another feature of the present invention to solve these problems by providing a narrow base. An advantage to be derived is that a patient may keep his legs close together in a comfortable position during use.

Another feature of the present invention is the solution of the problems associated with flexing the ankle simultaneously with the flexing of the knee. An advantage to be derived is a simple mechanism whereby the angle of flexure of the knee and the angle of flexure of the ankle may be independently adjusted.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like or corresponding parts in the several figures and wherein:

BRIEF DESCRIPTION OF THE DRAWINGS

FIG. 2 is an enlarged side elevation view of the control instrument located at the side of the knee in a first angular position of the thigh and calf support members;

FIG. 3 is a view similar to FIG. 2 showing another position of the thigh and calf support members;

FIGS. 4 and 5 are sectional views taken along the lines 4—4 and 5—5, respectively, in FIG. 2;

FIG. 6 is a partial perspective view of the control instrument of FIGS. 2—5 showing the adjustable angle indicators;

FIG. 7 is an enlarged side elevation view of the ankle flex control mechanism located at the side of the knee opposite to the control instrument;

FIGS. 8 and 9 are sectional views taken along the lines 8—8 and 9—9, respectively, in FIG. 7;

DESCRIPTION OF THE PREFERRED EMBODIMENT

Figure 1:
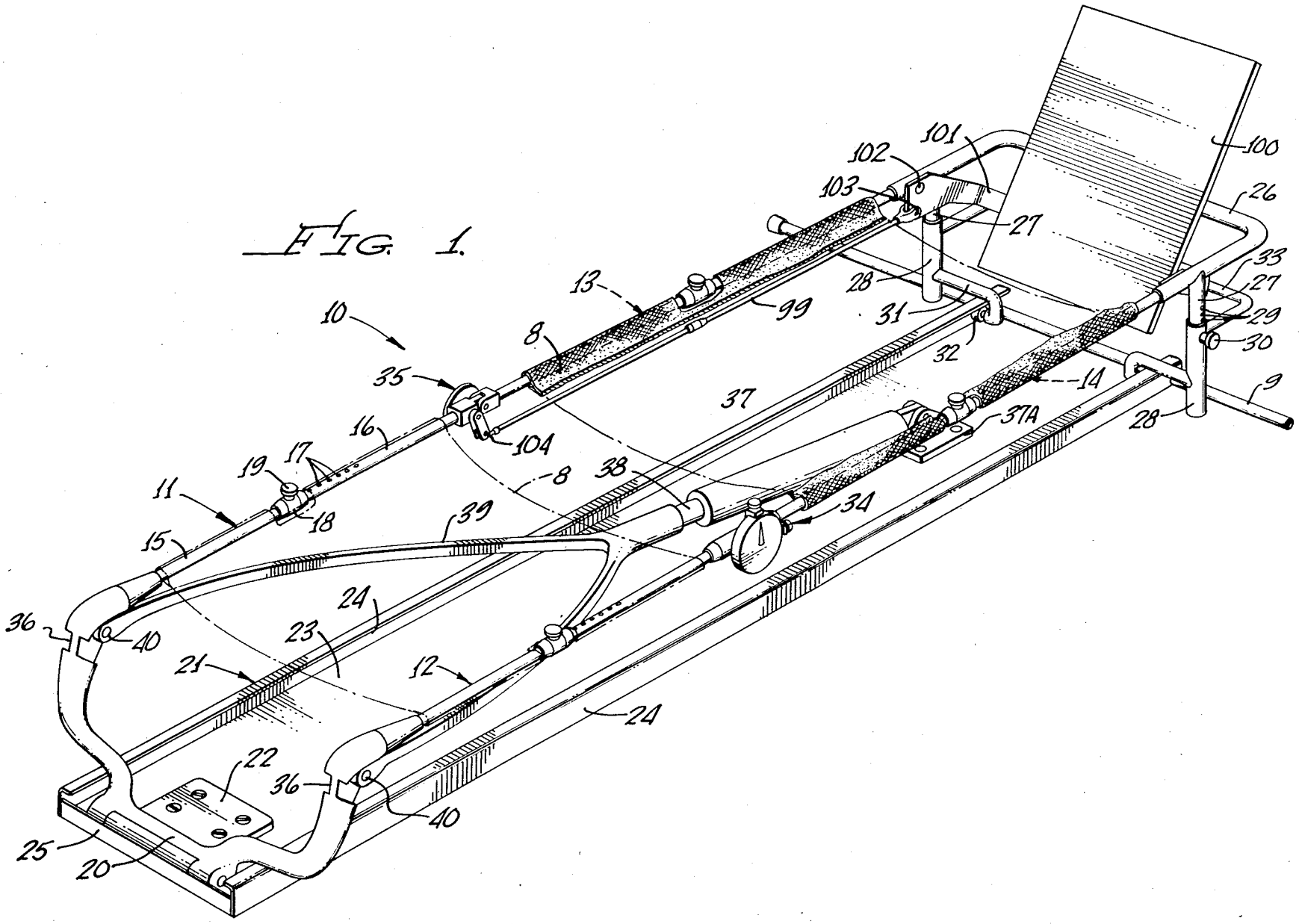
FIG. 1 is a perspective view of a continuous passive motion orthopedic device constructed in accordance with the teachings of the present invention.
Figure 9:
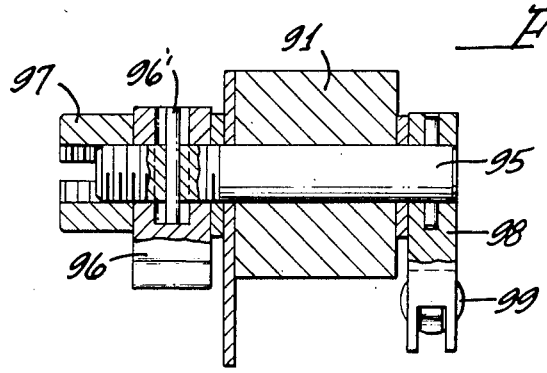
Figure 10:
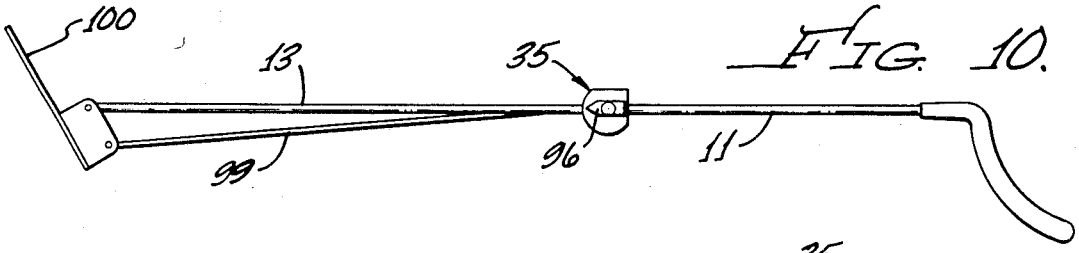
FIGS. 10—13 are a series of simplified side elevation views showing the operation of the ankle flex control mechanism.
Figure 11:
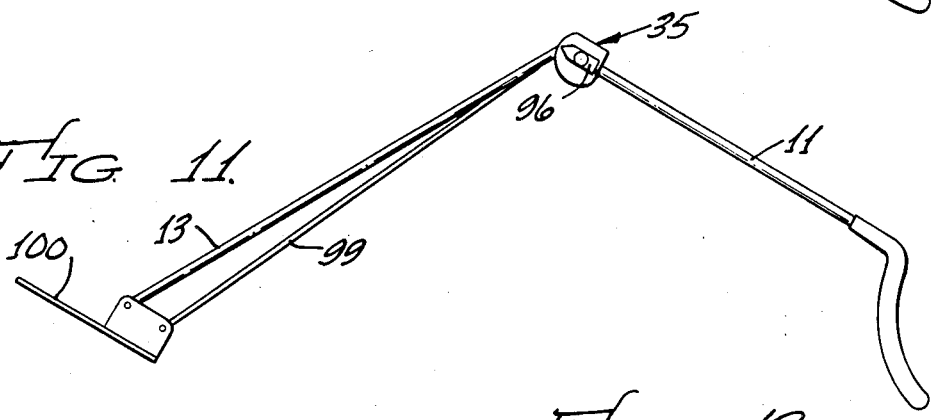
Figure 12:
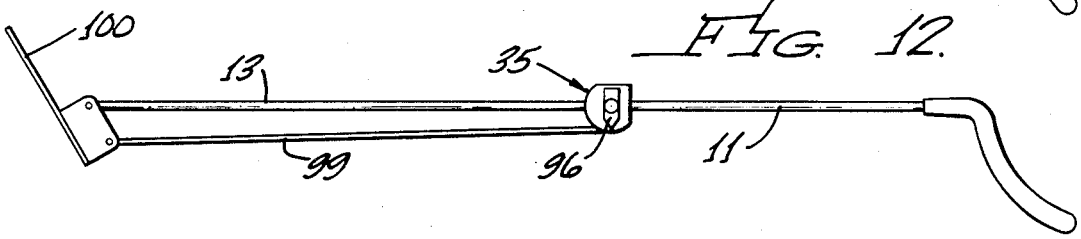
Figure 13:
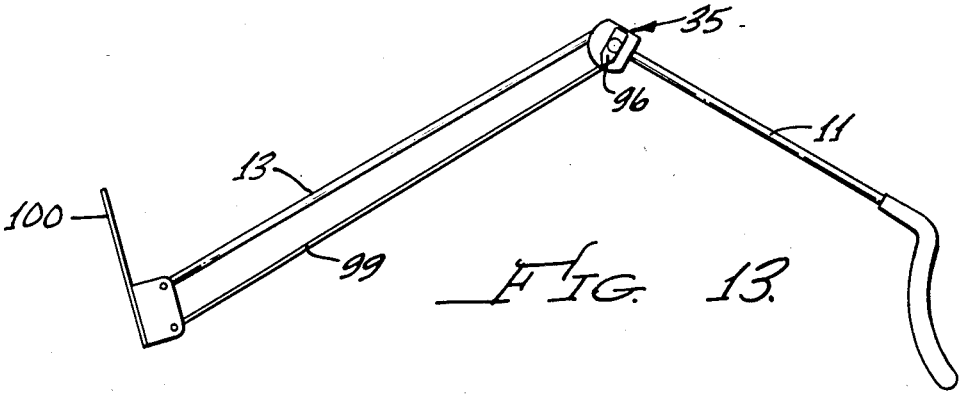

Referring now to the drawings and, more particularly, to FIG. 1 thereof, there is shown a continuous passive motion orthopedic device, generally designated 10, which is designed for the exercising of limbs for therapy, rehabilitation or healing. Orthopedic device 10 is specifically designed for exercising the knee of a patient and optionally his ankle too. Device 10 is a framework designed to lie beneath the patient's leg, suspending the leg on a cradle of soft material between two tubular rails while the patient is lying on a bed.

More specifically, device 10 includes a first pair of rails, generally designated 11 and 12, and a second pair of rails, generally designated 13 and 14. Each of rails 11-14 is made from two telescoping parts so that the lengths thereof may be readily adjusted to accommodate the length of the thigh and calf of the particular patient. For example, rail 11 includes first and second tubular members 15 and 16, tubular member 16 extending into and through tubular member 15. Tubular member 16 has a plurality of holes 17 therein and member 15 has a mechanism 18 connected to the free end thereof which supports a pin 19 which is adapted to engage one of holes 17 in member 16 to establish the relative positions between members 15 and 16. The construction of rails 12-14 is identical. Rails 11 and 12 function as part of a thigh support means and rails 13 and 14 function as part of a calf support means. Sheets 8 of soft material (partially shown) extend between rails 11 and 12 and between rails 13 and 14 for the thigh and calf, respectively of a patient to rest on.

First ends of rails 11 and 12 are interconnected, as shown at 20, and are pivotally connected to one end of a base, generally designated 21, by means of a suitable hinge structure 22. Base 21 is preferably made from a thin sheet of metal and is adapted to rest on the top surface of a bed. It may, for example, be 40" long and 6" wide. Base 21 has a bottom 23 and flanged sides 24. The opposite ends 25 may also be bent up and welded to sides 24, giving base 21 rigidity. An outrigger rod 9 extends through the other end of base 21, through sides 24, to prevent device 10 from tipping over when in the raised position. Rod 9 may be removed during shipping.

First ends of rails 13 and 14 are adapted to be supported by base 121 for movement therealong. More specifically, first ends of rails 13 and 14 are connected to the open ends of a U-shaped member 26. Member 26 has a pair of posts 27 extending downwardly from opposite sides thereof, posts 27 extending into tubular members 28. Posts 27 have a plurality of holes 29 therein which are adapted to be engaged by pins 30 connected to members 28. In this manner the foot of the patient is capable of being raised, allowing the entire leg to rest at an angle as flat as 3° or as steep as 20°. At various degrees of elevation in between, the height can be fixed in place.

A cross member 33 is connected between the upper ends of members 28 to provide rigidity adjacent the foot of the patient. The lower ends of members 28 are connected to first ends of L-shaped members 31, the other ends of which support bearings (not shown) which support wheels 32. As shown, wheels 32 fit within side flanges 24 and can roll lengthwise.

The other ends of the thigh and calf support members are pivotally interconnected; rails 12 and 14 are interconnected by means of a mechanism 34, to be described more fully hereinafter, and rails 11 and 13 being interconnected by a mechanism 35, to be described more fully hereinafter. Mechanisms 34 and 35 correspond in position to the knee joint of the patient.

At the hip end of orthopedic device, at base 21, hinge 22 pivotally connects the first ends of rails 11 and 12 to one end of base 21. From hinge 22, rails 11 and 12 extend almost vertically and then have dog legs therein, as shown at 36, so that the remainder of rails 11 and 12 extend almost horizontally. Dog legs 36 occur approximately 4" from hinge 22 and provide another hinge point. This is the point at which the lifting force is applied. As a force is applied to this hinge point, it causes rails 11 and 12 to pivot about hinge 22. This raises rails 11 and 12. As mechanisms 34 and 35 are elevated, they pull rails 13 and 14 along with them, with wheels 32 rolling along bottom surface 23 of base 21.

According to the preferred embodiment of the invention, the lifting force is applied by means of a linear drive means, here shown as a hydraulic cylinder 37. One end of cylinder 37 is pivotally connected to bottom surface 23 of base 21 by a suitable hinge 37A. Extending from the other end of cylinder 37 is a piston 38. Piston 38 is connected to the closed end of a wishbone-shaped drive fork 39. The open ends of drive fork 39 are connected to rails 11 and 12, at dog legs 36, by pins 40. It is evident that an electric motor with screw drive or other linear actuator may be used.

It should be noted that such arrangement permits the driving of rails 11–14 with a very short stroke from cylinder 37. Furthermore, the entire drive mechanism lies below the calf of the patient, making for a very compact mechanism. Wishbone-shaped drive fork 39 straddles the thigh, allowing the upper leg to be nestled inside of it. The shortened travel of piston 38 still permits a large degree of knee rotation, the ankle and foot of the patient being pulled therealong. This system increases the force required from cylinder 37, but this is easily handled.

As mentioned previously, the leg will rest on sheets 8 of soft material extending between rails 11–14. Activation of cylinder 37 will cause the leg suspended in the framework to be bent at the knee at the same angle as the framework. When the angle of the knee has reached a desired point, the force is reversed, returning the knee back down to its starting position, where the cycle repeats. A typical cycle time is 30 to 120 seconds.

Mechanism 34 includes a control instrument, generally designated 40. Instrument 40 can be set at the end points of the desired flex angle and will switch the direction of the travel when the end points are reached. The construction and operation of mechanism 34 and control instrument 40 may be best understood with reference to FIGS. 2–6.

As shown in FIG. 5, the ends of rails 12 and 14 are formed into a tongue 41 and a fork 42, respectively, tongue 41 extending into fork 42. A pin 43 extends through tongue 41 and fork 42 and forms the center of rotation. Pin 43 is connected to fork 42, such as by means of a locking pin 44, so that pin 43 cannot rotate relative to fork 42. Pin 43 extends through a bearing 45 in tongue 41 to permit rotation of tongue 41 relative to pin 43.

Control instrument 40 includes a body 46 which is attached firmly to tongue 41 by means of a screw 47. In this manner, body 46 of control instrument 40 rotates with rail 12, as shown in FIGS. 2 and 3. Control instrument 40 includes a control shaft 48 which is an extension of hinge pin 43. Thus, as the tongue and fork move relative to each other, control shaft 48 moves relative to body 46. Connected to shaft 48 and extending perpendicularly thereto is a spring actuator 49. Also connected to shaft 48 and extending perpendicular thereto is a pointer 50. Surrounding shaft 48 and mounted for rotation relative thereto is a dial face 51 which has angular markings thereon, as shown in FIGS. 2 and 3. Actuator 49 is positioned in back of dial face 51 and pointer 50 is positioned in front of dial face 51. A transparent cover 52 extends in front of dial face 51 and pointer 50 and is connected to body 46.

Control instrument 40 also includes a pair of angle setting mechanisms 53 and 54 which are, for all practical purposes, identical. More specifically, setting mechanism 54 includes a plate 55, one end of which is mounted for rotation on shaft 48. The other end of plate 55 includes two perpendicular flanges 56 and 57, between which extends the rim 58 of cover 52. The body of plate 55 supports a conductive pin 59 which is spaced by an insulator 60 from plate 55. A screw 61 extends through flange 57 in position to engage rim 58, screw 61 having a suitable knob 62 at the outer end thereof.

Setting mechanism 53 has a similar construction including a plate 63, flanges 64 and 65, a pin 66, an insulator 67, a screw 68 and a knob 69.

In operation, knobs 62 and 69 can be rotated to retract screws 61 and 68 from rim 58 of cover 52 whereby the positions of setting mechanisms 53 and 54 may be adjusted. Once the desired positions are determined, such as the zero and 90° positions shown in FIGS. 2 and 3, knobs 62 and 69 may be tightened whereby a fixed relationship is established between setting mechanisms 53 and 54, rim 58, cover 52 and body 46 of control instrument 40. All of these elements rotate with tongue 41. On the other hand, shaft 48, actuator 49 and pointer 50 rotate with fork 42. Thus, as the knee joints pivot between the position shown in FIG. 2 and the position shown in FIG. 3, pointer 50 moves relative to dial face 51 and actuator 49 moves between pins 59 and 66.

In this regard, pins 59 and 66 are positioned to intersect actuator 49 and pins 59 and 66 and actuator 49 may be used to generate electrical command signals to signal a suitable controller for cylinder 37 to reverse direction.

Figure 14:
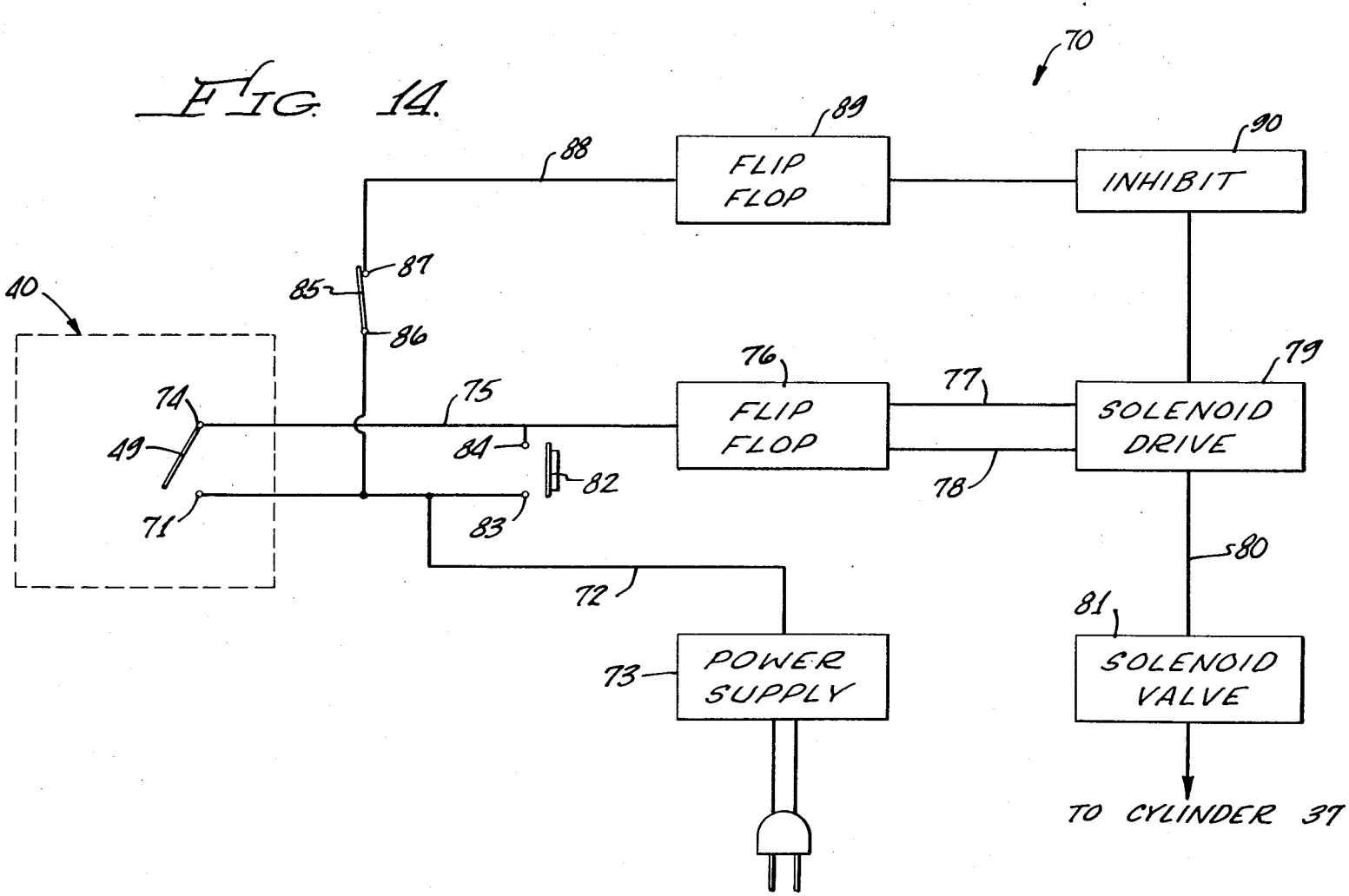
FIG. 14 is a circuit diagram of the electrical control circuit of the device.

A suitable circuit 70 for controlling the reversing of device 10 is shown in FIG. 14. That is, pins 59 and 66 may be connected together and to one terminal 71 of control circuit 70. Terminal 71 may be connected via a line 72 which extends to a remote location to a DC power supply 73. Actuator 49 may be connected to another terminal 74 which is connected via a lead 75 to a remote terminal where it is connected to the input of a conventional flip/flop 76 having complementary outputs 77 and 78. These outputs may be connected to a solenoid drive 79, the output of which is connected via a line 80 to a solenoid valve 81. Thus, every time actuator 49 contacts either pin 59 or pin 66, a signal is sent to flip/flop 76 causing it to change state, causing solenoid drive 79 to reverse the direction of solenoid valve 81. Valve 81 would control the direction of flow of fluid to cylinder 37.

Circuit 70 may also include a reversing switch 82 so that the direction of drive of cylinder 37 may be manually reversed. Upon depression of switch 82, it comes into contact with two terminals 83 and 84. Terminal 83 is connected to line 72 and terminal 84 is connected to line 75 so that connection of terminals 83 and 84 functions in the same manner described previously when spring 49 contacts either terminal 59 or 66.

Circuit 70 may also have a suitable on/off switch 85. Switch 85 is connected to a terminal 86 which is connected to power supply 73 via line 72. Closing of switch 85 connects terminal 86 to a terminal 87 connected via a line 88 to a flip/flop 89 having complementary outputs. When switch 85 is closed, one of the outputs activates an inhibit circuit 90 which prevents operation of solenoid drive 79.

Turning now to FIGS. 7–13, as the knee exerciser cycles up and down, it is desirable to be able to control the motion of the ankle joint relative to the lower leg. Accordingly, at the left side of device 10 is an ankle flexing mechanism 35. More specifically, one end of rail 11 is connected to a member 91 having a tongue 92 and one end of rail 13 is connected to a fork 93. A pin 94 extending through tongue 92 and fork 93 pivotally interconnects rails 11 and 12. Member 91 supports a shaft 95, one end of which is threaded and supports a pointer 96 and a locking nut 97 whereby shaft 95 and pointer 96 can be rotated through an angle of 90° relative to member 91 and held at any desired position in between.

Connected to the other end of shaft 95 is one end of a lever arm 98. Pointer 96 and lever arm 98 are both pinned, via pins 96' and 98', respectively, to opposite ends of shaft 95 so that the turning of pointer 96 to a different position also moves lever arm 98 to a different relative position. The other end of lever arm 98 is pivotally connected via a pin 104 to a shaft 99, the length of which may be adjusted in the same manner as discussed previously with regard to rails 11–14.

Device 10 also includes an ankle plate 100 on which the foot of the patient may be rested. Plate 100 is supported by a U-shaped bracket 101, the opposite ends of which are pivotally connected by pins 102 to the ends of member 26. In this manner, ankle plate 100 may pivot relative to rails 13 and 14. The other end of shaft 99 is connected to bracket 101 by a pin 103 which is offset from the axis of pin 102. Thus, shaft 99 controls the flexing of ankle plate 100.

More specifically, the old way to accomplish the flexing of the ankle joint relative to the lower leg was by having a plate at the knee hinge with a number of set points to which a rod, such as rod 99, is attached. The other end of the rod is attached to the foot plate. The farther from the center line of the hinge that the rod is attached to the plate, the greater the degree of ankle flex. This is illustrated by FIGS. 6–8 of U.S. Pat. No. 4,323,060.

According to the present invention, a lever of infinite variability is included which allows any angle of ankle flex to be selected in any degree. Rotation of shaft 95 changes the relative positions of pins 94 and 104 which allows them to move toward and away from each other, but keeps them in rotational position to each other. To set the angle, nut 97 is loosened, freeing pointer 96 and arm 98 to turn together. As arm 98 rotates away from the knee hinge centerline, it provides an offset between the drive points for plate 100. The lever is turned to the position indicative of the desired angle of flex and the nut is tightened. Tightening of nut 97 compresses two friction washers 105, locking the position of arm 98 relative to member 91.

The operation can be seen by comparing FIGS. 10 and 11 and 12 and 13. With arm 98 in the position shown in FIGS. 10 and 11, there will be no rotation of plate 100 as the knee is flexed. On the other hand, with arm 98 rotated through an angle of 90° to the position shown in FIGS. 12 and 13, there will be the maximum flexing of ankle plate 100 during flexing of the knee. Any desired degree of ankle flex between these extremes can be set, as described previously.

While the invention has been described with respect to the preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. A continuous passive motion orthopedic device comprising:

(a) an elongate base;

(b) thigh support means comprising a first pair of substantially horizontally disposed straight rails of telescopically adjustable length having soft material extending therebetween for the thigh to rest on, said rails having first and second ends, each of said first ends being attached to a substantially vertically disposed portion of dog leg configuration whose lowermost extremity is pivotally connected to one end of said base;

(c) calf support means comprising a second pair of substantially horizontally disposed straight rails of telescopically adjustable length having soft material extending therebetween for the calf to rest on, said rails having first and second ends, each of said first ends being pivotably interconnected to the corresponding second end of said first rails, the second ends of said second rails engaging said base and being supported thereby for movement along said base;

(d) linear drive means, one end of said drive means being connected to said base adjacent the end closest the second ends of said second rails, a drive fork having a narrow end connected to the other end of said drive means and a wide end pivotably connected to the vertically disposed portions associated with the first ends of said first pair of rails and (e) means mounted at the intersection between said thigh and calf support means for generating an electrical command signal to signal said drive means to reverse direction, said signal generating means including adjustable means for setting two different angles between said calf support means and said thigh support means where said drive means will be signalled to reverse direction.

2. A continuous passive motion orthopedic device according to claim 1, wherein said thigh and calf support means are interconnected by means of a pin connected to one of said thigh and calf support means and extending through the other of said thigh and calf support means and wherein said signal generating means support means and wherein said signal generating means comprises:

a housing connected to the other of said thigh and calf support means for movement therewith whereby said pin rotates relative to said housing during movement of said thigh and calf support means;

a first electrical contact mounted on said pin; and second electrical contacts mounted on said adjustable means.

3. A continuous passive motion orthopedic device according to claim 2, further comprising:

electrical circuit means connected to said first and second electrical contacts for generating said electrical command signal whenever said first electrical contact engages either of said second electrical contacts.

4. A continuous passive motion orthopedic device comprising:

an elongate base;

thigh support means, one end of said thigh support means being pivotally connected to one end of said base;

calf support means, one end of said calf support means engaging said base and being supported thereby for movement along said base, the other end of said thigh and calf support means being pivotally interconnected;

linear drive means, one end of said drive means being connected to said base, adjacent the other end thereof;

a drive fork, the narrow end of said drive fork being connected to the other end of said drive means, the wide end of said drive fork being connected to said thigh support means, closely adjacent said one end thereof;

means mounted at the intersection between said thigh and calf support means for generating an electrical command signal to signal said drive means to reverse direction, said signal generating means including adjustable means for setting two different angles between said calf support means and said thigh support means where said drive means will be signalled to reverse direction;

ankle support means pivotally connected to said one end of said calf support means;

an elongate rod, one end of said rod being connected to said ankle support means for controlling the angle thereof; and means mounted adjacent the intersection between said thigh and calf support means for controlling the angle of pivot of said ankle support means during movement of said thigh and calf support means, the other end of said rod being connected to said angle controlling means, said angle controlling means including means for setting the angular amount of pivot of said ankle support means between two predetermined angular amounts, said setting means permitting infinite variability of said angular amount between said predetermined angular amounts.

5. A continuous passive motion orthopedic device according to claim 4, wherein one of said predetermined angular amounts is zero.

6. A continuous passive motion orthopedic device according to claim 4, wherein said angle controlling means comprises:

a lever, one end of said lever being pivotally connected adjacent the intersection between said thigh and calf support means, the other end of said rod being connected to the other end of said lever, and wherein said setting means comprises:

means for setting the angle of said lever.

7. A continous passive motion orthopedic device comprising:

an elongate base;

thigh support means, one end of said thigh support means being pivotally connected to one end of said base;

calf support means, one end of said calf support means engaging said base and being supported thereby for movement along said base, the other end of said thigh and calf support means being pivotally interconnected;

linear drive means, one end of said drive means being connected to said base, adjacent the other end thereof;

a drive fork, the narrow end of said drive fork being connected to the other end of said drive means, the wide end of said drive fork being connected to said thigh support means, closely adjacent said one end thereof;

ankle support means pivotally connected to said one end of said calf support means;

an elongate rod, one end of said rod being connected to said ankle support means for controlling the angle thereof; and means mounted adjacent the intersection between said thigh and calf support means for controlling the angle of pivot of said ankle support means during movement of said thigh and calf support means, the other end of said rod being connected to said angle controlling means, said angle controlling means including means for setting the angular amount of pivot of said ankle support means between two predetermined angular amounts, said setting means permitting infinite variability of said angular amount between said predetermined angular amounts.

8. A continuous passive motion orthopedic device according to claim 7, wherein one of said predetermined angular amounts is zero.

9. A continuous passive motion orthopedic device according to claim 7, wherein said angle controlling means comprises:

a lever, one end of said lever being pivotally connected adjacent the intersection between said thigh and calf support means, the other end of said rod being connected to the other end of said lever, and wherein said setting means comprises:

means for setting the angle of said lever.

10. A continuous passive motion orthopedic device comprising:

an elongate base;

thigh support means, one end of said thigh support means being pivotally connected to one end of said base;

calf support means one end of said calf support means engaging said base and being supported thereby for movement along said base, the other ends of said thigh and calf support means being pivotally interconnected;

a linear drive means connected to said thigh support means for pivoting said thigh support means relative to said base; and means mounted at the intersection between said thigh and calf support means for generating an electrical command signal to signal said drive means to reverse direction, said signal generating means including adjustable means for setting two different angles between said calf support means and said thigh support means where said drive means will be signalled to reverse direction.

11. A continuous passive motion orthopedic device according to claim 10, wherein said thigh and calf support means are interconnected by means of a pin connected to one of said thigh and calf support means and extending through the other of said thigh and calf support means and wherein said signal generating means comprises:

a housing connected to the other of said thigh and calf support means for movement therewith whereby said pin rotates relative to said housing during movement of said thigh and calf support means;

a first electrical contact mounted on said pin; and second electrical contacts mounted on said adjustable means.

12. A continuous passive motion orthopedic device according to claim 11, further comprising:

electrical circuit means connected to said first and second electrical contacts for generating said electrical command signal whenever said first electrical contact engages either of said second electrical contacts.

13. A continuous passive motion orthopedic device comprising:

an elongate base;

thigh support means, one end of said thigh support means being pivotally connected to one end of said base;

calf support means, one end of said calf support means engaging said base and being supported thereby for movement along said base; the other ends of said thigh and calf support means being pivotally interconnected;

linear drive means connected to said thigh support means for pivoting said thigh support means relative to said base;

means mounted at the intersection between said thigh and calf support means for generating an electrical command signal to signal said drive means to reverse direction, said signal generating means including adjustable means for setting two different angles between said calf support means and said thigh support means where said drive means will be signalled to reverse direction;

ankle support means pivotally connected to said one end of said calf support means;

an elongate rod, one end of said rod being connected to said ankle support means for controlling the angle thereof, and means mounted adjacent the intersection between said thigh and calf support means for controlling the angle of pivot of said ankle support means during movement of said thigh and calf support means, the other end of said rod being connected to said angle controlling means, said angle controlling means including means for setting the angular amount of pivot of said ankle support means between two predetermined angular amounts, said setting means permitting infinite variability of said angular amount between said predetermined angular amounts.

14. A continuous passive motion orthopedic device according to claim 13, wherein one of said predetermined angular amounts is zero.

15. A continuous passive motion orthopedic device according to claim 13, wherein said angle controlling means cmprises:

a lever, one end of said lever being pivotally connected adjacent the intersection between said thigh and calf support means, the other end of said rod being connected to the other end of said lever, and wherein said setting means cmprises:

means for setting the angle of said lever.

16. A continuous passive motion orthopedic device comprising:

an elongate base;

thigh support means, one end of said thigh support means being pivotally connected to one end of said base;

calf support means, one end of said calf support means engaging said base and being supported thereby for movement along said base, the other ends of said thigh and calf support means being pivotally interconnected;

linear drive means connected to said thigh support means for pivoting said thigh support means relative to said base;

ankle support means pivotally connected to said one end of said calf support means;

an elongate rod, one end of said rod being connected to said ankle support means for controlling the angle thereof; and means mounted adjacent the intersection between said thigh and calf support means for controlling the angle of pivot of said ankle support means during movement of said thigh and calf support means, the other end of said rod being connected to said angle controlling means, said angle controlling means including means for setting the angular amount of pivot of said ankle support means between two predetermined angular amounts, said setting means permitting infinite variability of said angular amount between said predetermined angular amounts.

17. A continuous passive motion orthopedic device according to claim 16, wherein one of said predetermined angular amounts is zero.

18. A continuous passive motion orthopedic device according to claim 16, wherein said angle controlling means comprises:

a lever, one end of said lever being pivotally connected adjacent the intersection between said thigh and calf support means, the other end of said rod being connected to the other end of said lever, and wherein said setting means comprises:

means for setting the angle of said lever.

* * * * *